US008529007B2

(12) United States Patent
Folkins et al.

(10) Patent No.: US 8,529,007 B2
(45) Date of Patent: Sep. 10, 2013

(54) METHOD AND SYSTEM FOR REFLEX PRINTING TO COMPENSATE FOR REGISTRATION ERRORS IN A CONTINUOUS WEB INKJET PRINTER

(75) Inventors: Jeffrey J. Folkins, Rochester, NY (US); Yongsoon Eun, Webster, NY (US); Todd Thayer, Rochester, NY (US); R. Enrique Viturro, Rochester, NY (US); Jess R. Gentner, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 515 days.

(21) Appl. No.: 12/941,389

(22) Filed: Nov. 8, 2010

(65) Prior Publication Data

US 2012/0113176 A1 May 10, 2012

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS

| | | | |
|---|---|---|---|
| 4,401,024 | A | 8/1983 | Frentress |
| 4,887,530 | A | 12/1989 | Sainio |
| 4,990,767 | A | 2/1991 | Ernst et al. |
| 5,325,159 | A | 6/1994 | Day |
| 5,455,668 | A | 10/1995 | De Bock et al. |
| 5,499,093 | A | 3/1996 | Aerens et al. |
| 5,539,498 | A | 7/1996 | De Cock et al. |
| 5,600,352 | A | 2/1997 | Knierim et al. |
| 5,828,937 | A | 10/1998 | Aerens et al. |
| 5,887,236 | A | 3/1999 | Hirao et al. |
| 6,049,680 | A | 4/2000 | Goris et al. |
| 6,072,587 | A | 6/2000 | Hicks |
| 6,076,922 | A | 6/2000 | Knierim |
| 6,215,119 | B1 | 4/2001 | Markham et al. |
| 6,266,437 | B1 | 7/2001 | Eichel et al. |
| 6,330,424 | B1 | 12/2001 | Chapman et al. |
| 6,407,678 | B1 | 6/2002 | Elgee et al. |
| 6,639,669 | B2 | 10/2003 | Hubble, III et al. |
| 7,245,862 | B2 | 7/2007 | Ebara |
| 7,467,838 | B2 | 12/2008 | Folkins et al. |
| 7,583,920 | B2 | 9/2009 | Willemsens et al. |
| 7,584,699 | B2 | 9/2009 | Ford |
| 7,587,157 | B2 | 9/2009 | Matsuda et al. |
| 7,607,746 | B2 * | 10/2009 | Koehler et al. ..... 347/5 |
| 7,647,018 | B2 | 1/2010 | Moore et al. |
| 8,272,708 | B2 * | 9/2012 | Silverbrook et al. ..... 347/14 |
| 2002/0131800 | A1 | 9/2002 | Jacob et al. |
| 2003/0210932 | A1 | 11/2003 | Koide et al. |
| 2006/0072939 | A1 | 4/2006 | Kremer et al. |
| 2006/0109329 | A1 | 5/2006 | Holtman et al. |
| 2006/0109330 | A1 | 5/2006 | Holtman |
| 2006/0114302 | A1 | 6/2006 | Holtman |
| 2008/0088661 | A1 | 4/2008 | Folkins et al. |
| 2009/0265950 | A1 | 10/2009 | Mizes et al. |
| 2009/0293750 | A1 | 12/2009 | Haenni et al. |

* cited by examiner

*Primary Examiner* — Laura Martin
(74) *Attorney, Agent, or Firm* — Maginot, Moore & Beck, LLP

(57) ABSTRACT

A method of operating a printer enables compensation parameters to be generated and stored in association with system conditions detected at the time of the compensation parameter generation. Upon detection of corresponding system conditions at a later time, the printer is able to use the previously generated and stored compensation parameters to adjust the timing of printhead ejections to improve the registration in ink images formed by the system.

19 Claims, 5 Drawing Sheets

METHOD AND SYSTEM FOR REFLEX PRINTING TO COMPENSATE FOR REGISTRATION ERRORS IN A CONTINUOUS WEB INKJET PRINTER

TECHNICAL FIELD

This disclosure relates generally to moving web printing systems, and more particularly, to moving web printing systems that use a reflex system to register images printed by different printheads.

BACKGROUND

Web printing systems are known that implement either a single reflex or a double reflex registration system to time the delivery of firing signals to printheads in a print zone of the web printing system. "Double reflex registration system" refers to a system that uses the angular velocity signals corresponding to the rotation of two or more rollers to compute the web velocity at a printhead positioned between the rollers. A single reflex registration system refers to a system that uses the angular velocity signals corresponding to the rotation of only one roller to compute a linear web velocity that is used to predict web positions and timing in a print zone. "Reflex mode" as used in this document refers to a printer being operated with either a double reflex registration system or a single reflex registration system. Some printers are capable of being operated in either reflex mode.

To implement reflex printing control, a controller can use tension measurements from load cells that provide measurements of web tension along with the angular velocity measurements from encoders associated with rollers in the web printing system to compute linear web velocities at various locations in the system. These linear velocities enable the processor to determine when a web portion previously printed by one marking station is opposite another marking station so the second marking station can be operated by the controller with firing signals to eject ink of a different color onto the web in proper registration with the ink already placed on the web by a previous marking station. Additionally, reflex printing controls enables the printing at any given marking station to be deposited in an equally spaced and uniform manner. Operation of a subsequent marking station either before or after the ejected ink arrives at the subsequent marking station may produce visual noise in the image. This effect is known as registration error. Accurate measurements, therefore, are important in registration of different colored images on the web to produce images with little or no visual noise. That is, accurate angular velocity measurements simplify the process of determining the linear velocity of the web at a particular position and the timing of the firing signals correlated to the linear web velocity.

Accurate measurements can be affected by changes arising from environmental conditions. For example, temperature changes may change the diameter of one or more roller cylinders significantly enough to affect the accuracy of the velocity computed for the web and the timing of the firing signals for the printheads that eject ink as the web passes by the printheads. Another environmental factor affecting the registration of images printed by different groups of printheads is web shrinkage. Web shrinkage is caused as the web is subjected to relatively high temperatures as the web moves along the relatively long path through the web printing system. The high temperatures drive moisture content from the web, which causes the web to shrink. If the physical dimensions of the web change after one group of printheads has formed an image in one color ink, but before another group of printheads has formed an image in another color of ink, then the registration of the two images is affected. The change may be sufficient to cause registration errors between ink patterns ejected by the different groups of printheads. The amount of shrinkage depends upon the heat to which the web is subjected, the speed of the web as it moves over heated components, the moisture content of the paper, and the type of paper, for example. Additionally, the amount of water in the web alters the elasticity of the web and the computations for web velocities with those changes. Addressing the effect of web changes and environmental conditions to reflex printing calculations during operation of a web printing system is important for image registration in web printing systems.

SUMMARY

A method of operating a printer enables a controller to identify parameters associated with compensation parameters that may then be used to generate more accurately firing signals for the printheads in the printer. The method includes generating image data of an image generated by the printer, identifying a registration error with reference to the image data, generating a compensation parameter corresponding to the identified registration error, detecting at least one condition measurement in a printer at a time corresponding to the image being generated by the printer, storing the compensation parameter in a memory of the printer in association with the one condition measurement, detecting at least one condition measurement in a printer that corresponds to the first condition measurement, retrieving from the memory the compensation parameter corresponding to the first condition measurement, generating a firing signal for printheads mounted to at least one print bar in the printer with reference to the retrieved compensation parameter, and delivering the firing signal to the printheads mounted to the at least one print bar to operate inkjet ejectors in the printheads with reference to the first condition measurement in the printer.

A printer is configured to use the method to generate firing signals with reference to compensation parameters associated with environmental and paper parameters. The printer includes a media transport that is configured to transport media through the printer in a process direction, a plurality of print bars, each print bar having a plurality of printheads mounted to a print bar and a printhead driver circuit that is operatively connected to each printhead mounted to a print bar to deliver a timing signal to each printhead mounted to the print bar to eject ink onto media being transported past the plurality of printheads on the print bar by the media transport in the process direction, an imaging device mounted proximate to a portion of the media transport to generate image data corresponding to a cross-process portion of the media being transported through the printer in the process direction after the media has received ink ejected from the printheads mounted to the print bars, at least one temperature sensor mounted in the printer, the at least one temperature sensor generating a signal indicative of a temperature in the printer, at least one web condition sensor mounted in the printer, the at least one web condition sensor generating a signal indicative of a web condition in the printer, an input device configured to enable input of operational parameters, and a controller operatively connected to the imaging device, the input device, the at least one temperature sensor, the at least one web condition sensor, and the printhead driver circuits for the plurality of print bars, the controller being configured to identify a registration error with reference to image data received from the imaging device, to generate a compensation parameter corresponding to the identified registration error, to detect with reference to the signals generated by the at least one temperature sensor, at least one web condition sensor, and the input device, a first plurality of conditions in the printer at a time at which the printer generated an image corresponding to the image data from which the registration error was identified, and to store the compensation parameter in a memory of the printer in association with the first plurality of conditions.

BRIEF DESCRIPTION OF THE DRAWINGS

The foregoing aspects and other features of a printing system that obtains compensation parameters with reference to environmental and/or web conditions are explained in the following description, taken in connection with the accompanying drawings.

DETAILED DESCRIPTION

Figure 1:
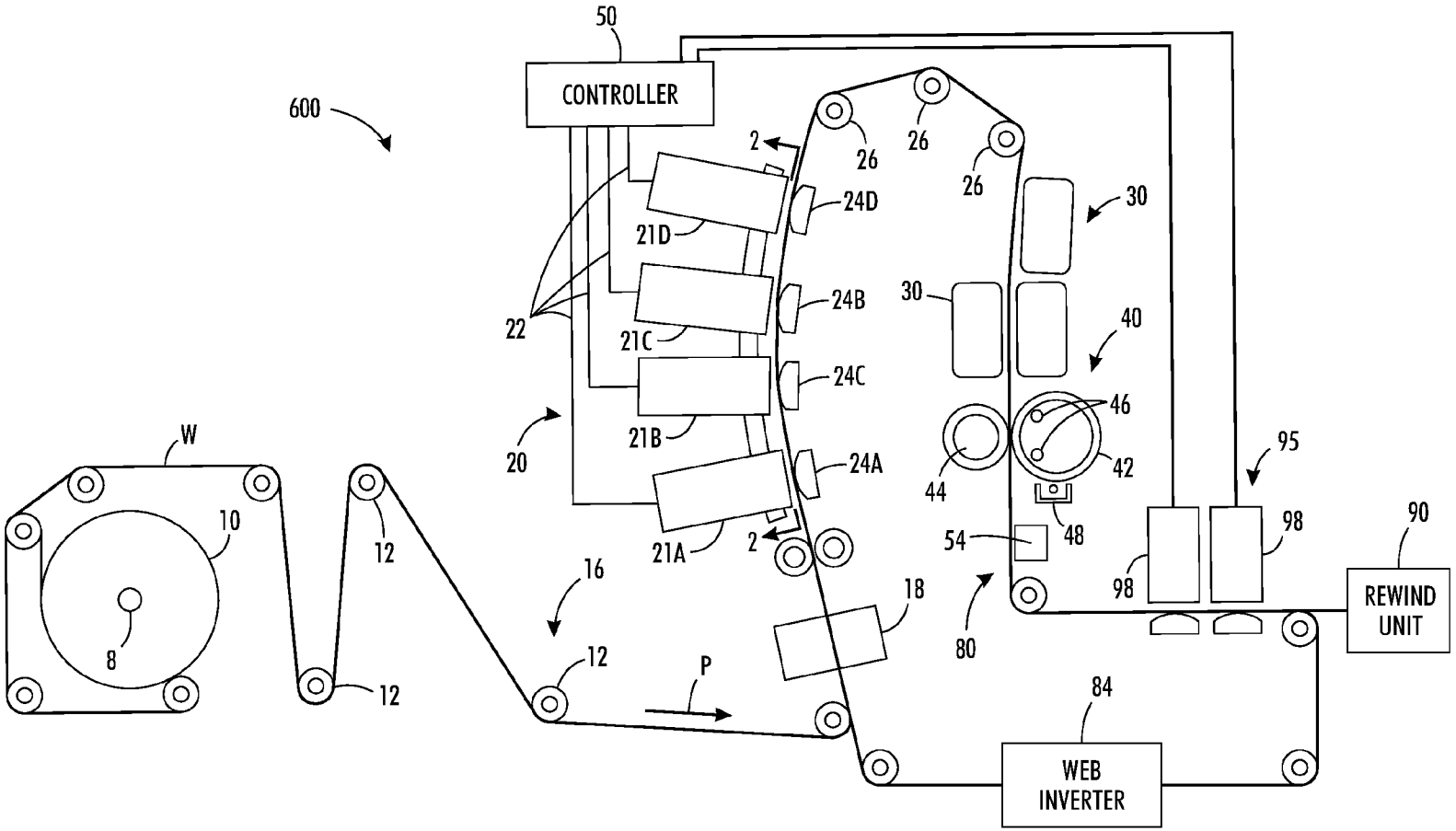
FIG. 1 is a schematic view of an improved inkjet imaging system that obtains compensation parameters with reference to environmental and/or web conditions to attenuate registration errors arising from the environmental and/or web conditions.

The imaging system of the printing system shown in FIG. 1 includes a print engine to process the image data before generating the control signals for the inkjet ejectors for ejecting colorants. Colorants may be ink, or any suitable substance that includes one or more dyes or pigments and that may be applied to the selected media. The colorant may be black, or any other desired color, and a given imaging apparatus may be capable of applying a plurality of distinct colorants to the media. The media may include any of a variety of substrates, including plain paper, coated paper, glossy paper, films, plastics, or transparencies, among others, and the media may be available in sheets, rolls, or another physical formats.

Direct-to-sheet, continuous-media, phase-change inkjet imaging system 600 includes a media supply and handling system configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 95, and rewind unit 90. For duplex operations, the web inverter 84 is used to flip and shift the web's position over to present a second side of the media to the printing station 20, printed web conditioner 80, and coating station 95 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 95 before being flipped by the inverter 84 and laterally displaced by a distance that enables the web to travel over the other half of the rollers opposite the printing station 20, printed web conditioner 80, and coating station 95 for the printing, conditioning, and coating, if necessary, of the reverse side of the web. The rewind unit 90 is configured to wind the web onto a roller for removal from the printer and subsequent processing.

The media may be unwound from the source 10 as needed and propelled by a variety of motors, not shown, that rotate one or more rollers. The media conditioner includes rollers 12 and a pre-heater 18. The rollers 12 control the tension of the unwinding media as the media moves along a path through the printer. In alternative embodiments, the media may be transported along the path in cut sheet form in which case the media supply and handling system may include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The preheater 18 may use contact, radiant, conductive, or convective heat to bring the media to a target preheat temperature, which in one practical embodiment, is in a range of about 30° C. to about 70° C.

The media is transported through a printing station 20 that includes a series of color units or modules 21A, 21B, 21C, and 21D, each color unit effectively extends across the width of the media and is able to eject ink directly (i.e., without use of an intermediate or offset member) onto the moving media. The arrangement of printheads in the print zone of system 600 is discussed in more detail with reference to FIG. 2. As is generally familiar, each of the printheads may eject a single color of ink, one for each of the colors typically used in color printing, namely, cyan, magenta, yellow, and black (CMYK). The controller 50 of the printer receives velocity data from encoders mounted proximately to rollers positioned on either side of the portion of the path opposite the four printheads to calculate the linear velocity and position of the web as the web moves past the printheads. The controller 50 uses these data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to image data processed by the controller 50. The image data may be transmitted to the printer, generated by a scanner (not shown) that is a component of the printer, or otherwise generated and delivered to the printer. In various possible embodiments, a color unit for each primary color may include one or more printheads; multiple printheads in an module may be formed into a single row or multiple row array; printheads of a multiple row array may be staggered; a printhead may print more than one color; or the printheads or portions thereof can be mounted movably in a direction transverse to the process direction P, also known as the cross-process direction, such as for spot-color applications and the like. As described in more detail below, the controller 50 generates a firing signal for each print bar unit or a group of print bar units positioned proximate one another. The firing signal is then delivered with reference to delay values stored in the print bar unit or the group of print bar units to compensate for misalignment of the printheads in the process direction.

The printer may use "phase-change ink," by which is meant that the ink is substantially solid at room temperature and substantially liquid when heated to a phase change ink melting temperature for jetting onto the imaging receiving surface. The phase change ink melting temperature may be any temperature that is capable of melting solid phase change ink into liquid or molten form. In one embodiment, the phase change ink melting temperature is approximately 70° C. to 140° C. In alternative embodiments, the ink utilized in the imaging device may comprise UV curable phase change ink. UV curable phase change ink may also be heated before being ejected by the inkjet ejectors of the printhead. As used herein, liquid ink refers to melted solid ink, melted phase change ink, or other known forms of ink, such as aqueous or aqueous-based inks, ink emulsions, ink suspensions, ink solutions, solvent-based inks, oil-based inks, conventional liquid UV curable inks, or the like.

Associated with each color module is a backing member 24A-24D, typically in the form of a bar or roll, which is arranged substantially opposite the printhead on the back side of the media. Each backing member is used to position the media at a predetermined distance from the printhead opposite the backing member. Each backing member may be configured to emit thermal energy to maintain the media to a predetermined temperature which, in one practical embodiment, is in a range of about 4$^{0o}$ C. to about 6$^{0o}$ C. The various backer members may be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore other temperature regulating devices may be employed to maintain the media temperature within a predetermined range. For example, the air temperature and air flow rate behind and in front of the media may also impact the media temperature. Accordingly, air blowers or fans may be utilized to facilitate control of the media temperature. Thus, the media temperature is kept substantially uniform for the jetting of all inks from the printheads of the printing station 20. Temperature sensors (not shown) may be positioned along this portion of the media path to enable regulation of the media temperature. These temperature data may also be used by systems for measuring or inferring (from the image data, for example) how much ink of a given primary color from a printhead is being applied to the media at a given time.

Following the printing station 20 along the media path are one or more "mid-heaters" 30. A mid-heater 30 may use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to −10° C. to 20° C. above the temperature of the spreader.

Following the mid-heaters 30, a fixing assembly 40 is configured to apply heat and/or pressure to the media to fix the images to the media. The fixing assembly may include any suitable device or apparatus for fixing images to the media including heated or unheated pressure rollers, radiant heaters, heat lamps, and the like. In the embodiment of the FIG. 1, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 may also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly may be configured to spread the ink using non-contact heating (without pressure) of the media after the print zone. Such a non-contact fixing assembly may use any suitable type of heater to heat the media to a desired temperature, such as a radiant heater, UV heating lamps, and the like.

In one practical embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high may cause ink to offset to the roll. In one practical embodiment, the nip pressure is set in a range of about 500 to about 2000 psi. Lower nip pressure gives less line spread while higher pressure may reduce pressure roller life.

The spreader 40 may also include a cleaning/oiling station 48 associated with image-side roller 42. The station 48 cleans and/or applies a layer of some release agent or other material to the roller surface. The release agent material may be an amino silicone oil having viscosity of about 10-200 centipoises. Only small amounts of oil are required and the oil carried by the media is only about 1-10 mg per A4 size page. In one possible embodiment, the mid-heater 30 and spreader 40 may be combined into a single unit, with their respective functions occurring relative to the same portion of media simultaneously. In another embodiment the media is maintained at a high temperature as it is printed to enable spreading of the ink.

The coating station 95 applies a clear ink to the printed media. This clear ink helps protect the printed media from smearing or other environmental degradation following removal from the printer. The overlay of clear ink acts as a sacrificial layer of ink that may be smeared and/or offset during handling without affecting the appearance of the image underneath. The coating station 95 may apply the clear ink with either a roller or a printhead 98 ejecting the clear ink in a pattern. Clear ink for the purposes of this disclosure is functionally defined as a substantially clear overcoat ink or varnish that has minimal impact on the final printed color, regardless of whether or not the ink is devoid of all colorant. In one embodiment, the clear ink utilized for the coating ink comprises a phase change ink formulation without colorant. Alternatively, the clear ink coating may be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink may be heated to about 100° C. to 140° C. to melt the solid ink for jetting onto the media.

Following passage through the spreader 40 the printed media may be wound onto a roller for removal from the system (simplex printing) or directed to the web inverter 84 for inversion and displacement to another section of the rollers for a second pass by the printheads, mid-heaters, spreader, and coating station. The duplex printed material may then be wound onto a roller for removal from the system by rewind unit 90. Alternatively, the media may be directed to other processing stations that perform tasks such as cutting, binding, collating, and/or stapling the media or the like.

Operation and control of the various subsystems, components and functions of the system 600 are performed with the aid of the controller 50. The controller 50 may be implemented with general or specialized programmable processors that execute programmed instructions. The instructions and data required to perform the programmed functions may be stored in memory associated with the processors or controllers. The processors, their memories, and interface circuitry configure the controllers and/or print engine to perform the functions, such as the electrical motor calibration function, described below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Controller 50 may be operatively connected to the print bar and printhead motors of color modules 21A-21D in order to adjust the positions of the printhead bars and printheads in the cross-process direction across the media web. The controller 50 may be configured with programmed instructions to implement one or both of the registration processes identified below.

The imaging system 600 may also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The light source for the imaging system may be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment may include three linear arrays, one for each of the colors red, green, and blue. Alternatively, all of the LEDS may be arranged in a single linear array in a repeating sequence of the three colors or the light source may be white light. The LEDs of the light source may be coupled to the controller 50 or some other control circuitry to activate the LEDs for image illumination. Imaging system 54 must be placed after the marking systems 21 but may be either before or after any of the post-printing systems 30, 40, or 95.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array may be configured to translate across the image substrate. For example, the linear array may be mounted to a movable carriage that translates across image receiving member. Other devices for moving the light sensor may also be used.

Figure 2:
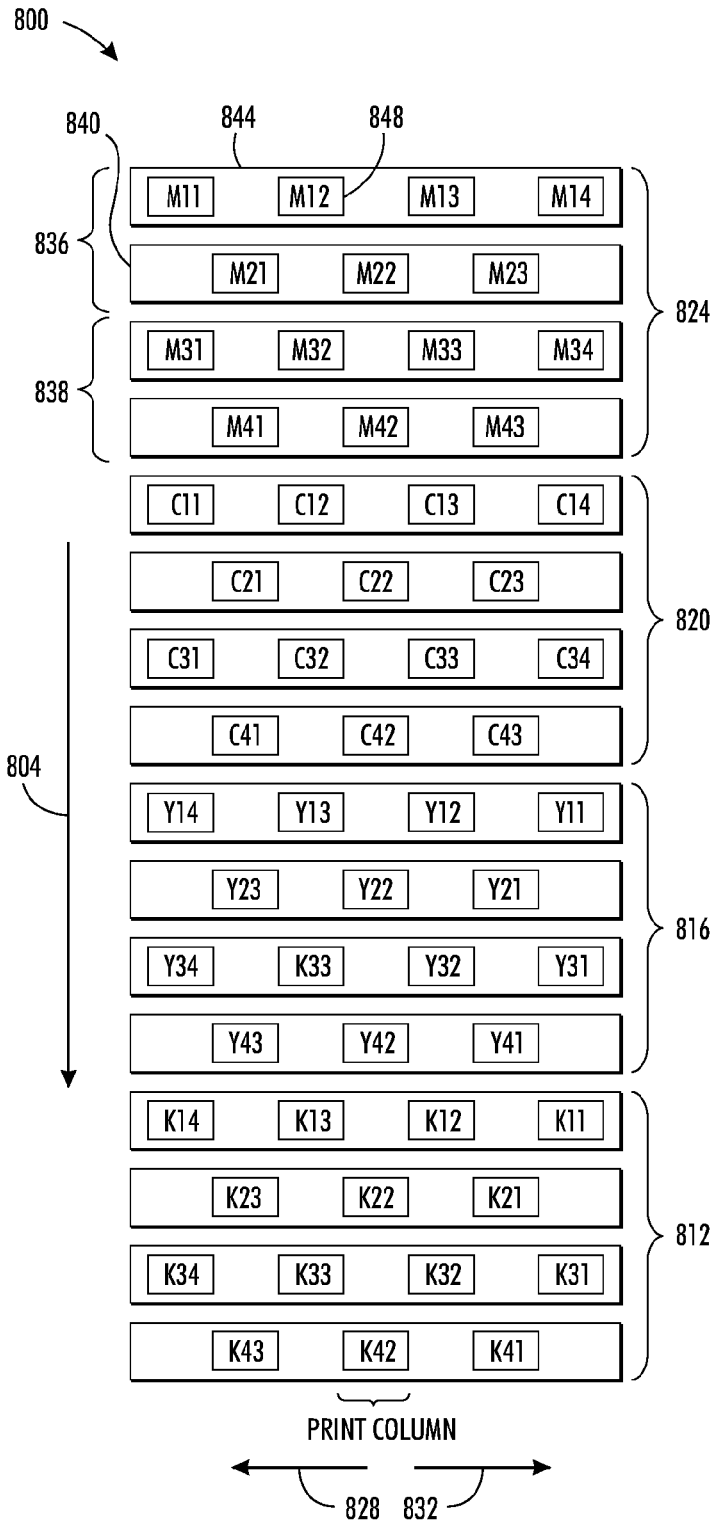
FIG. 2 PRIOR ART
FIG. 2 is a schematic view of a prior art printhead configuration that may be used in the system of FIG. 1 as viewed along lines 7-7.

A schematic view of a print zone 800 that may be used in the system 600 is depicted in FIG. 2. The print zone 800 includes four color modules or units 812, 816, 820, and 824 arranged along a process direction 804. Each color unit ejects ink of a color that is different than the other color units. In one embodiment, color unit 812 ejects black ink, color unit 816 ejects yellow ink, color unit 820 ejects cyan ink, and color unit 824 ejects magenta ink. Process direction 804 is the direction that an image receiving member moves as travels under the color unit from color unit 824 to color unit 812. Each color unit includes two print arrays, which include two print bars each that carry multiple printheads. For example, the print bar array 836 of magenta color unit 824 includes two print bars 840 and 844. Each print bar carries a plurality of printheads, as exemplified by printhead 848. Print bar 840 has three printheads, while print bar 844 has four printheads, but alternative print bars may employ a greater or lesser number of printheads. The printheads on the print bars within a print bar array, such as the printheads on the print bars 840 and 844, are staggered to provide printing across the image receiving member in the cross process direction at a first resolution. The printheads on the print bars of the print bar array 836 within color unit 824 are interlaced with reference to the printheads in the print bar array 838 to enable printing in the colored ink across the image receiving member in the cross process direction at a second resolution. The print bars and print bar arrays of each color unit are arranged in this manner. One print bar array in each color unit is aligned with one of the print bar arrays in each of the other color units. The other print bar arrays in the color units are similarly aligned with one another. Thus, the aligned print bar arrays enable drop-on-drop printing of different primary colors to produce secondary colors. The interlaced printheads also enable side-by-side ink drops of different colors to extend the color gamut and hues available with the printer.

Figure 3:
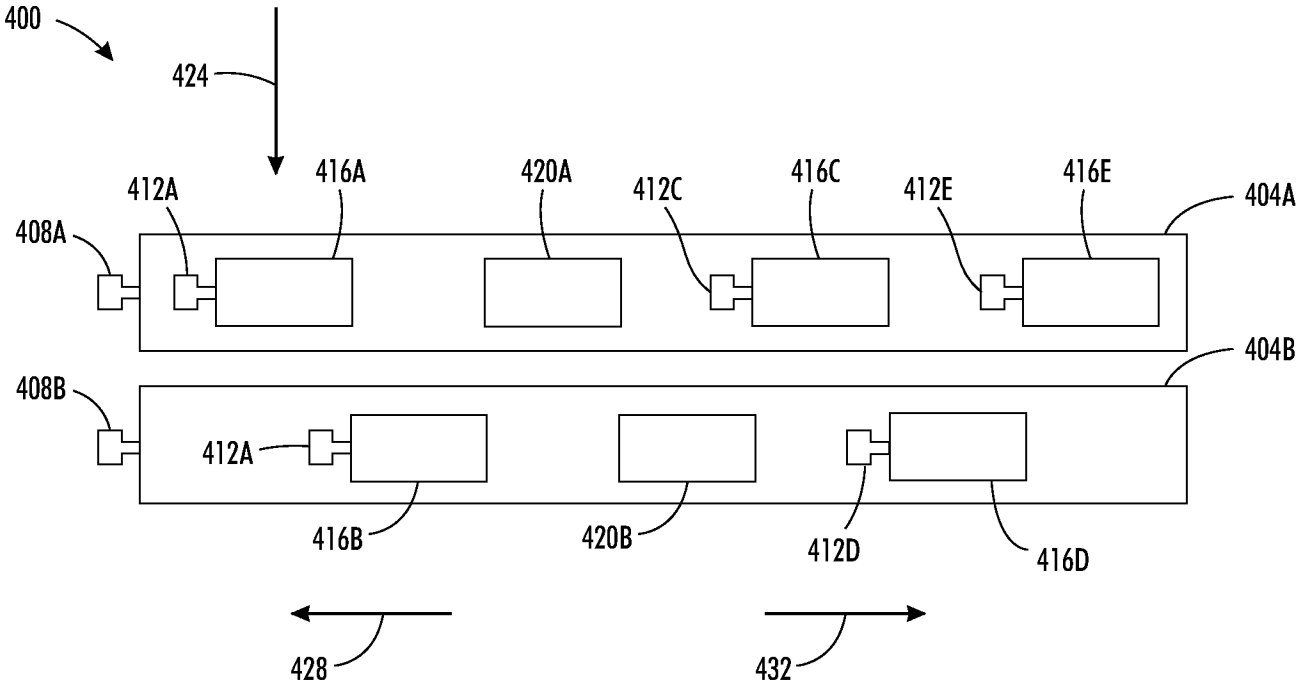
FIG. 3 is a schematic view of a print bar unit that may be used in the imaging system of FIG. 1.

FIG. 3 depicts a configuration for a pair of print bars that may be used in a color module of the system 600. The print bars 404A and 404B are operatively connected to the print bar motors 408A and 408B, respectively, and a plurality of printheads 416A-E and 420A, 420B are mounted to the print bars. Printheads 416A-E are operatively connected to electrical motors 412A-E, respectively, while printheads 420A and 420B are not connected to electrical motors, but are fixedly mounted to the print bars 404A and 404B, respectively. Each print bar motor moves the print bar operatively connected to the motor in either of the cross-process directions 428 or 432. Printheads 416A-416E and 420A-420B are arranged in a staggered array to allow inkjet ejectors in the printheads to print a continuous line in the cross-process direction across a media web. Movement of a print bar causes all of the printheads mounted on the print bar to move an equal distance. While the print bar units of FIG. 2 are depicted with a plurality of printheads mounted to each print bar, one or more of the print bars may have a single printhead mounted to the bar. Such a printhead would be long enough in the cross-process direction to enable ink to be ejected onto the media across the full width of the document printing area of the media.

A test pattern may be printed onto media at the initialization of printing system operation, start of a job run, or during a job run by printing a portion of the test pattern in an inter-document zone on the media. Image data of the test pattern on the media is generated by the imaging system described above and processed by an image processing program implemented by one or more processors in the printing system. The analysis of the image data enables the positions of the printheads to be identified as well as any cross-process dimensional changes in the media as the media moves through the print zone. This positional information may be used to detect and identify registration occurring in images printed by the printheads of the printer. As used in this document, registration error refers to an amount of displacement in the process direction for ink images produced by different printheads that causes visual noise in the final image. The amount of the registration error may be quantified and a compensation value identified. The compensation value, for example, may be a time parameter used to activate the printheads mounted to one of the print bars. As used in this document, "timing parameter" refers to an amount of time that is used to adjust delivery of a firing signal to a printhead driver circuit or to a printhead to compensate for a registration error in the process direction. By either delaying or advancing the time at which the printheads are activated to eject ink, the registration error may be attenuated or eliminated. The compensation parameter is then associated with the environmental, time, web, or event identifying data for storage in a memory of the printer. Thereafter, once the same or similar environmental, time, web, or event conditions are detected, they may be used to retrieve the compensation parameter from the memory and the compensation parameter may then be used to operate the printheads to address the registration error that occurs when those conditions or events are encountered.

A test pattern that may be used to identify registration error is disclosed in U.S. Utility application Ser. No. 12/754,730 hereby entitled "Test Pattern Effective For Coarse Registration Of Inkjet Printheads And Method Of Analysis Of Image Data Corresponding To The Test Pattern In An Inkjet Printer", which is commonly owned by the owner of this document and was filed on Apr. 6, 2010, the disclosure of which is incorporated into this document by reference in its entirety. Another appropriate registration test pattern that may be used is disclosed in U.S. Utility application Ser. No. 12/754,735 hereby entitled "Test Pattern Effective For Fine Registration Of Inkjet Printheads And Method Of Analysis Of Image Data Corresponding To The Test Pattern In An Inkjet Printer", which is commonly owned by the owner of this document and was filed on Apr. 6, 2010, the disclosure of which is incorporated into this document by reference in its entirety.

At steady state for a printing system, such as the one shown in FIG. 1, the average web velocity times the web material mass per length must be equal at all rollers or other non-slip web interface surfaces. Otherwise, the web would either break or go slack. To account for the differences in instantaneous velocities at rollers in or near a print zone, a double reflex processor interpolates between linear web velocities at a pair of rollers, one roller on each side of a marking station with reference to the direction of the moving web, to identify a linear velocity for the web at a position proximate the marking station. This interpolation uses the linear web velocity derived from the angular velocity of a roller placed at a position before the web reaches the marking station and the linear web velocity derived from the angular velocity of a roller placed at a position after the web passes by the marking station along with the relative distances between the marking station and the two rollers. The interpolated value correlates to a linear web velocity at the marking station. A linear web velocity is interpolated for each marking station. The interpolated web velocity at each marking station enables the processor to generate the firing signals for the printheads in each marking station to eject ink as the appropriate portion of the web travels past each marking station.

To address registration errors that may arise from web changes arising from environmental conditions or web parameters, a method and system have been developed that associate timing correction parameters with one or more environmental conditions and/or web parameters to enable the generation and delivery of timing signals that operate printheads more accurately for the detected system conditions. A system 200 that identifies environmental and/or web parameters at various positions in the web printing system and that computes compensation parameters corresponding to the identified environmental and/or web parameters is shown in block diagram form in FIG. 4. As depicted in that figure, the web printing system 200 includes the system controller 50, a digital front end (DFE) 204, a binary image processor 208, the printhead interface and waveform amplifier boards 216, a plurality of printheads 220, web temperature sensors 224, roller temperature sensors 228, encoders and tension sensors 230, a registration processor 232, a web imaging device 54, and a printhead controller 238.

In more detail, the system controller 50 receives control information for operating the web printing system from a digital front end (DFE) 204. During a job, image data to be printed are also provided by the DFE to the web printing system components that operate the printheads to eject ink onto the web and form ink images that correspond to the images provided by the DFE. These components include the binary image processor 208 and the printhead interface and waveform amplifier boards 216. The binary processor performs binary imaging processes. Each printhead interface and waveform amplifier board 216 generates the firing signals that operate the inkjet ejectors in the printheads 220 that are electrically coupled to one of the boards 216. Registration and color control are provided by the registration processor 232, which adjusts inkjet timing and printhead position. The imaging device 54 provides the registration processor 232 with image data of the web at a predetermined position along the web path through the web printing system. The registration controller performs signal processing on the image data received from the imaging device to determine the positions of the ejected ink on the web. The temperatures of the web at various locations in the web printing system are provided by the web temperature sensors 224, the temperatures of the rollers in the web printing system are provided by the roller temperature sensors 228, and the angular velocities of the rollers and the tension on the web at various locations are provided by the encoders and tension sensors 230. These temperature, velocity, and tension values are environmental and web condition parameters that are provided to the printhead controller 238. The system controller 50 may also receive web parameter and event data through an input device 226, such as a touch screen, keypad, or other actuating or data entry device. The printhead controller 238 may receive these data from the system controller 50 through a common bus in the printer. These values may be used as described below to compute modified angular velocities for the rollers and web velocities, compensation parameters, and to identify a plurality of conditions existing in the printer at a particular time.

Figure 4:
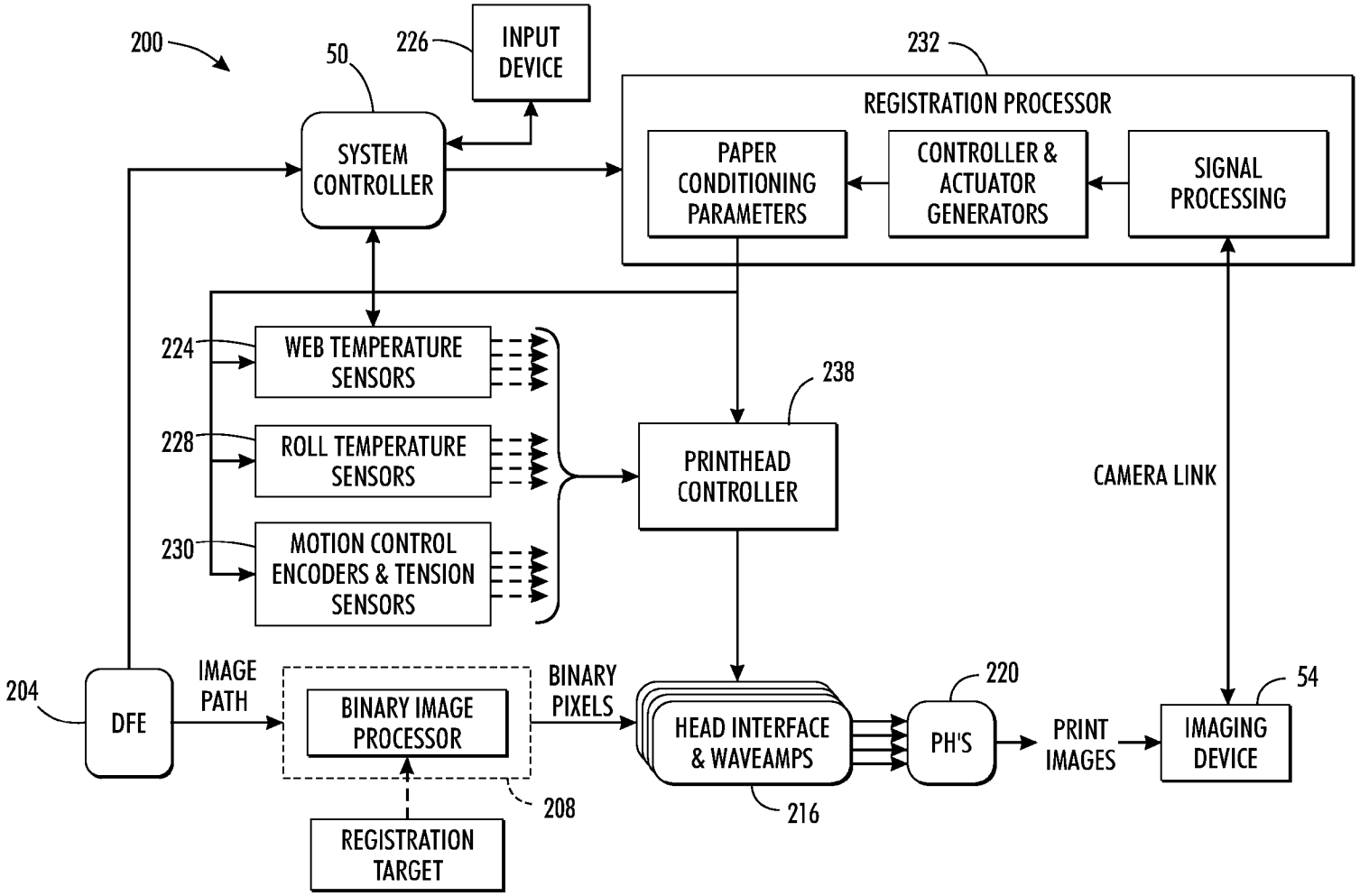
FIG. 4 is a block diagram of a web printing system that obtains compensation parameters with reference to environmental and/or web conditions and generates firing signals that compensate for registration errors arising from the environmental and/or web conditions.

The printhead controller 238 in FIG. 4 also receives position error data from the registration processor 232. These data may also be used to compute compensation parameters for the web velocity computations. Additionally, the printhead controller is configured to associate the compensation parameters with a set of identifiers and values for the environmental conditions and/or web parameters and store a compensation parameter in association with the set of identifiers and values. For example, the first images printed in a job run may be empirically determined to require an offset or variation that slowly goes away with continued running. Thus, a compensation parameter identified for the offset or variation is stored in association with a start of run identifier. In another example, the actual elapsed time since a last print run may be identified as an event that is associated with a compensation parameter to compensate for registration errors from the lack of activity in the printing system. Other events include a maintenance service, a long print run, or the like. Similarly, the type and/or duration of a set of environmental conditions (e.g., sensed temperatures at one or more rollers or positions along the media path) may be associated with a compensation parameter.

In the system 200 shown in FIG. 4, the temperature sensors for the rollers 228 are mounted in proximity to rollers in the web printing system, which are typically located in the area immediately before, immediately after, and within the area populated with the printheads. These sensors provide temperature signals to the printhead controller 238 that correspond to a temperature of the roller mounted proximate the sensor. Thus, the controller 238 is able to detect the temperature of a roller in the print zone from the signals received from the temperature sensor mounted proximate the roller. In the web velocity measurement process, web velocity may be approximated by the equation: $V_{web}=\omega_{roller}\times(d+th_{paper})/2$, where $V_{web}$ is the web velocity, $\omega_{roller}$ is the angular velocity of a roller obtained from a rotary encoder, d is the diameter of the roller, and $th_{paper}$ is the effective thickness of the web. In a controller that uses a single reflex registration process to compute web velocity and position for the timing of printhead firing, the diameter of only one roller is used for the computation. If the diameter of the roller is treated as a constant, errors are introduced in the web velocity and position calculations as the actual diameter of the roller or rollers used in the registration process changes in response to a temperature change in the roller. In order to address the diameter changes introduced by temperature variations, a coefficient of thermal expansion is identified for each roller. Additionally, the thickness or cross-sectional area of the web affects the web velocity calculation and this web parameter may change with a change in web temperature. Also, the elasticity modulus for the web affects the level of web stretch under the applied web tension and, consequently, image registration. In order to address these web parameter changes introduced by temperature variations, a coefficient of thermal expansion is identified for the elasticity modulus and cross-sectional area of the web.

Errors in the angular velocity signals generated by encoders operatively connected to the rollers may be introduced by changes in the diameter of a roller caused by thermal expansion of the roller. To address these sources of web speed and position error, a controller may use a coefficient of thermal expansion for a roller and a temperature differential that is measured with reference to the baseline temperature at which the coefficient of thermal expansion was measured to identify diameter variations in a roller at temperatures currently being sensed. These diameter variations may be stored in association with the sensed roller temperatures for later retrieval. The retrieved diameter variations may be used to modify the roller diameter values used to compute web velocity and position error. Similarly, a coefficient of thermal expansion identified for the elasticity modulus and cross-sectional area of the web may be stored in association with the temperatures at which the web parameters change.

The storage of compensation parameters in association with environmental conditions and/or web parameters enable the web imaging device to detect conditions that have been empirically determined to produce registration error and retrieve compensation parameters that are supplied to the printhead controller 238. These compensation parameters enable the printhead controller to correct for temperature induced web velocity measurement errors that arise from changes in web parameters, roller diameters, and printer events. The thermal expansion coefficient may be updated occasionally with reference to the coefficient correction data provided by the registration controller 232. Additionally, runtime temperature variation of the web may be estimated with reference to a measured temperature variation in a roller and, vice versa the runtime temperature variation of a roller may be estimated with reference to a measured temperature variation in the web. Estimates of temperature variations for either a roller or web may use a relationship between web and roller temperatures based on empirical and/or theoretical physical relationships. For example, an estimated web temperature may be based on roller temperature, web speed, web thickness, and wrap angle. Temperature measurements for each roller and the media, however, would be more precise. As used in this document, identification of a temperature or temperature difference includes estimating the temperature or temperature difference as well as measuring the temperature or temperature difference. "Measuring" a temperature or temperature difference means using a sensor to quantify a temperature, while "estimating" means using an empirically observed relationship, a theoretical relationship, or a combination of an empirically observed relationship and theoretical relationship with reference to another temperature or temperature difference to arrive at a temperature or temperature variation without directly measuring the temperature or temperature variation. As used in this document, "identify" and "calculate" include the operation of a circuit comprised of hardware, software, or a combination of hardware and software that reaches a result based on one or more measurements of physical relationships with accuracy or precision suitable for a practical application. Whereas the temperature of the web, the mechanisms, and rollers is a known direct influence on the registration errors with reflex printing, other factors may be more subtle and difficult to quantify and variable with time, machine history, etc. Accordingly the empirically derived compensation parameters are intended to correct for these other factors also.

Figure 5:
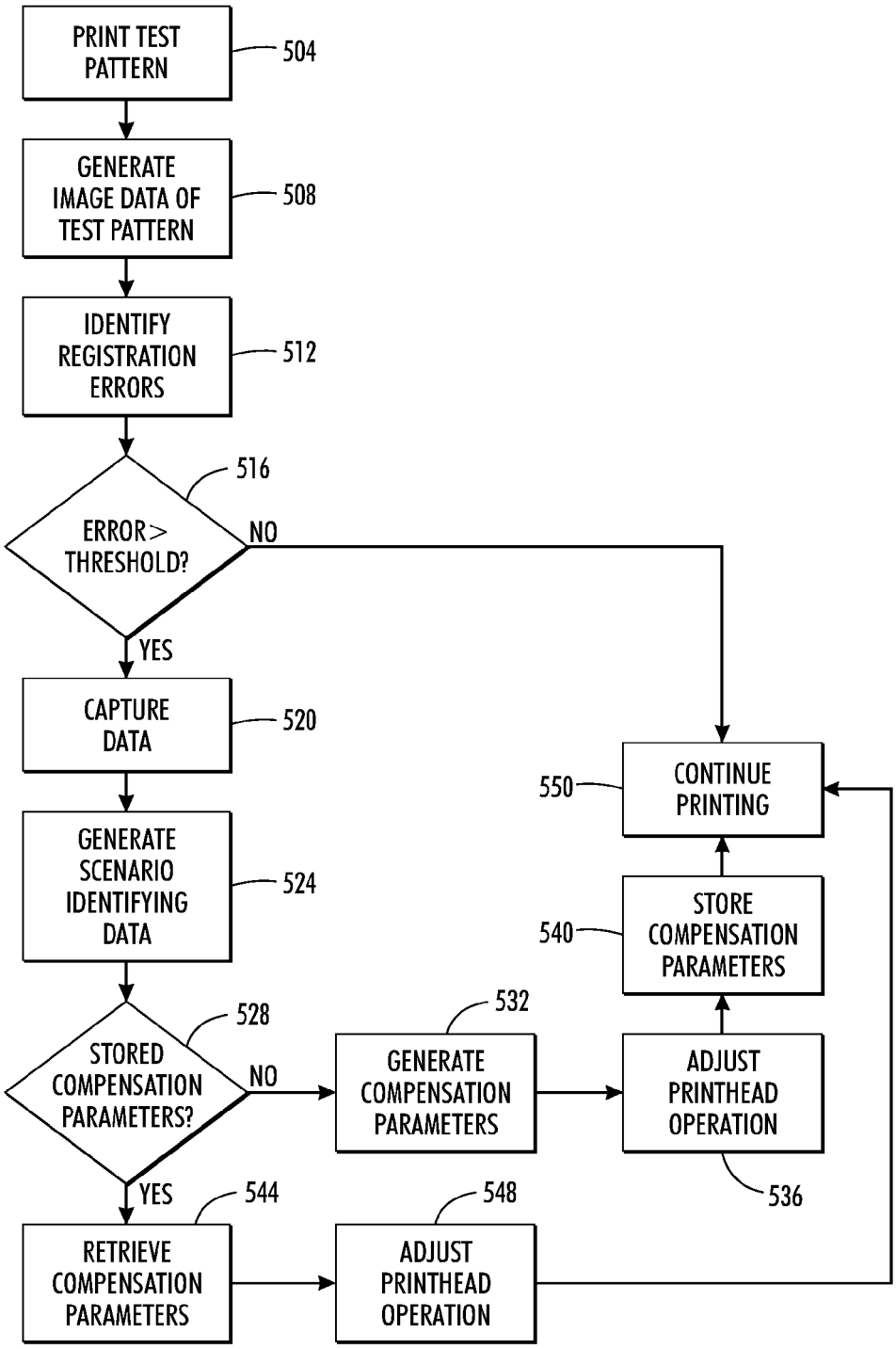
FIG. 5 is a flow diagram of a process for identifying and storing compensation parameters for use in addressing registration errors occurring in a web printing system.

The process shown in FIG. 5 may be used to measure registration error, generate a compensation parameter, and store the compensation parameter in association with an identifier or value for the environmental and/or web conditions. The process begins with the printing of a test pattern (block 504). Image data of the test pattern are generated (block 508). In one embodiment, the imaging system captures data from an imaging area that is approximately twenty inches wide in the cross process direction. The printheads print at a resolution of 600 dpi in the cross process direction and over 12,000 optical detectors are arrayed in a single row along the bar to generate a single scanline across the imaging member. The optical detectors are configured in association in one or more light sources that direct light towards the surface of the media web. After the image data corresponding to the test pattern are generated, the image data are used to identify registration errors (block 512).

If the registration errors are greater than a predetermined threshold (block 516), at least one condition measurement I captured (block 520). The conditions that may be measured include environmental, web, time, and event data. Otherwise, the printing process continues (block 550). The environmental data include the temperature measurements and estimates, encoder measurements, and tension measurements and estimates available from the sensors 224, 228, and 230. The web conditions may be identified with reference to these sensor data or from measurements obtained from the image data of one or more test patterns printed on the web. Time and/or event data, such as elapsed time from a particular event, may be generated as well. One or more of these environmental, web, time and event data may be selected and used to generate a set of identifiers and/or values (block 524). For example, temperature readings may be used in a hashing function to generate an identifier or value corresponding to the environmental conditions. The term "key" as used in this document refers to a value generated by a hashing function that may be associated with a compensation parameter for later retrieval of the compensation parameter. Similarly, an identifier or value may be generated for the web conditions or the current event transpiring in the web printing system. The set of identifiers and/or values are then used to determine whether one or more compensation parameters have been stored in association with the set of identifiers (block 528). If no compensation parameters have been stored for the set of identifiers and values, one or more compensation parameters are generated (block 532). As used in this document, the "correspondence" of detected condition measurements to previously identified condition measurements used to store compensation parameters refers to an exact or near match of an identifier that is generated from the detected condition measurement(s) to an identifier generated from previously detected condition measurement(s) or to a plurality of condition measurements with associated thresholds that enable a score to be generated from the number of current condition measurements that are within the thresholds about the previously detected condition measurements.

The compensation parameters are used to adjust timing parameters and/or firing signals to compensate for the detected registration errors (block 536). In one embodiment, printhead timing parameters are adjusted with the compensation parameters and sent to the printhead interface circuit 216 for each print bar where the printhead timing parameters are stored. The printhead controller 238, thereafter, generates a signal for the printhead interface to generate the printhead firing signals for operating the printheads in a manner that compensates for the registration error in the process direction. Alternatively, the printhead controller 238 may generate and deliver to a printhead interface circuit 216 a firing signal for each printhead with reference to the adjusted printhead timing parameters. The compensation parameter(s) are then stored in association with the set of identifiers and values (block 540) and printing continues (block 550). Thus, the compensation parameters can be simply retrieved rather generated upon the next occurrence of the environmental, or web conditions, or events that led to the generation of the compensation parameters. If the generated set of identifiers and/or values has one or more compensation parameters stored in association with the set, the compensation parameters are retrieved (block 544) and used to compensate for the registration errors (block 548). Printing then continues (block 550).

Once operation of the printing system commences, the system, from time to time, prints a registration target and captures image data of the registration target on the media to determine whether registration errors in the process direction remain within a predetermined tolerance. The registration target may be printed in inter-document zones on the media to interleave the registration verification with a print job. If the registration errors are greater than the predetermined tolerance, the environmental, web, and event data are captured and used to generate a set of identifying data. These data are used to determine whether compensation parameters have been previously generated in this situation. If compensation parameters have been previously generated, they are retrieved and used to adjust operation of one or more printheads to compensate for the detected registration errors. If compensation parameters have not been previously generated, they are generated, used to adjust operation of one or more printheads to compensate for the detected registration errors, and then stored in association with the set of identifying data for later use. In this manner, the printing system is able to learn to recognize situations requiring printhead operation compensation to attenuate registration errors and quickly apply the compensation parameters.

In the system and method described above, a data base history of registration performance as a function of the various conditions is generated and used to adjust operation of the printing system when similar situations are detected. Various correction factors can be automatically captured and updated on a regular basis. This database enables the printer "to learn" correction factors that could be applied to both the time and history corrections noted above as well as other parameter correction factors. These correction factors may be applied to either the frequency or offset timing of the printhead firing signals. These correction terms may be determined empirically either at a single occurrence or learned within a machine based on runtime data. For example, registration start errors may simply be averaged over the past several runs. These time and history based compensation factors are thought to improve the registration of first prints produced in a run as compared to control schemes that include closed loop image sensor feedback.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for generating firing signals for printheads in a printer comprising:

generating image data of an image generated by the printer;

identifying a registration error with reference to the image data;

generating a compensation parameter corresponding to the identified registration error;

detecting at least one condition measurement in a printer at a time corresponding to the image being generated by the printer;

storing the compensation parameter in a memory of the printer in association with the one condition measurement;

detecting at least one condition measurement in a printer that corresponds to the condition measurement detected in the printer at the time corresponding to the image being generated by the printer;

retrieving from the memory the compensation parameter corresponding to the condition measurement detected in the printer at the time corresponding to the image being generated by the printer;

generating a firing signal for printheads mounted to at least one print bar in the printer with reference to the retrieved compensation parameter; and delivering the firing signal to the printheads mounted to the at least one print bar to operate inkjet ejectors in the printheads with reference to the first condition measurement in the printer.

2. The method of claim 1, the detection of the condition measurement further comprising:

detecting a condition measurement for at least one of a temperature, web parameter, and time in the printer.

3. The method of claim 2, the detection of the condition measurement for time further comprising:

identifying an elapsed time since a detected event.

4. The method of claim 3 wherein the detected event is a maintenance action, an end of a print run, or a start of a print run.

5. The method of claim 3 wherein detection of the condition measurement includes a plurality of environmental conditions detected in the printer.

6. The method of claim 5 further comprising:

generating a key corresponding to the condition measurement in the printer; and storing the compensation parameter in the memory in association with the key.

7. The method of claim 2, the detection of the condition measurement for temperature further comprising:

detecting at least one temperature for a print zone or a backer roller in the printer.

8. The method of claim 2, the detection of the condition measurement for a web parameter further comprising:

detecting a media thickness, a media type, a web speed, or a reflex mode.

9. The method of claim 1, the generation of the firing signals further comprising:

adjusting a frequency or a delivery delay for a firing signal with reference to the compensation parameter retrieved from the memory.

10. A printer comprising:

a media transport that is configured to transport media through the printer in a process direction;

a plurality of print bars, each print bar having a plurality of printheads mounted to a print bar and a printhead driver circuit that is operatively connected to each printhead mounted to a print bar to deliver a timing signal to each printhead mounted to the print bar to eject ink onto media being transported past the plurality of printheads on the print bar by the media transport in the process direction;

an imaging device mounted proximate to a portion of the media transport to generate image data corresponding to a cross-process portion of the media being transported through the printer in the process direction after the media has received ink ejected from the printheads mounted to the print bars;

at least one temperature sensor mounted in the printer, the at least one temperature sensor generating a signal indicative of a temperature in the printer;

at least one web condition sensor mounted in the printer, the at least one web condition sensor generating a signal indicative of a web condition in the printer;

an input device configured to enable input of operational parameters; and a controller operatively connected to the imaging device, the input device, the at least one temperature sensor, the at least one web condition sensor, and the printhead driver circuits for the plurality of print bars, the controller being configured to identify a registration error with reference to image data received from the imaging device, to generate a compensation parameter corresponding to the identified registration error, to detect with reference to the signals generated by the at least one temperature sensor, at least one web condition sensor, and the input device, a first plurality of conditions in the printer at a time at which the printer generated an image corresponding to the image data from which the registration error was identified, and to store the compensation parameter in a memory of the printer in association with the first plurality of conditions.

11. The system of claim 10, the controller being further configured to detect a second plurality of conditions in the printer that correspond to the first plurality of conditions, the second plurality of conditions being detected with reference to a signal generated by the at least one temperature sensor, a signal generated by the at least one web condition sensor, a time detected in the printer, an event detected in the printer, and at least one operational parameter input through the input device, the controller also being configured to retrieve the compensation parameter stored in association with the first plurality of conditions from the memory operatively connected to the controller, to generate a firing signal for printheads mounted to at least one print bar in the printer with reference to the at least one compensation parameter, and to deliver the firing signal to the printhead driving circuit for the print bar to which the printheads are mounted to operate inkjet ejectors in the printheads with reference to the first plurality of conditions in the printer.

12. The printer of claim 11, the controller being further configured to detect the at least one operational parameter by receiving at least one web parameter from the input device.

13. The printer of claim 12, the at least one web parameter received from the input device identifying at least one of a media thickness, a media type, a web speed, and a reflex mode.

14. The printer of claim 11, the controller being further configured to detect the time in the printer with reference to an elapsed time since a detected event.

15. The printer of claim 14 wherein the controller is further configured to detect an event by detecting a maintenance action, an end of a print run, or a start of a print run.

16. The printer of claim 14 wherein the controller is further configured to detect an event by detecting a parameter received from the input device.

17. The printer of claim 11 wherein the at least one temperature sensor is positioned proximate a print zone or a backer roller in the printer.

18. The printer of claim 11, the controller being further configured to generate a key corresponding to the first plurality of conditions in the printer and to store the compensation parameter in the memory of the printer in association with key.

19. The printer of claim 11, the controller being further configured to generate the firing signals by adjusting a frequency or a delivery delay for a firing signal with reference to the compensation parameter retrieved from the memory.

* * * * *